US006082947A

United States Patent [19]

Adamson

[11] Patent Number: 6,082,947

[45] Date of Patent: Jul. 4, 2000

[54] COORDINATED MOTION MARINE LIFTING DEVICE

[76] Inventor: James E. Adamson, 8000 S. Flagler Dr., West Palm Beach, Fla. 33405

[21] Appl. No.: 09/375,659

[22] Filed: Aug. 17, 1999

[51] Int. Cl.[7] ..... B66C 23/53

[52] U.S. Cl. ..... 414/137.7; 212/308; 414/138.2; 414/139.6

[58] Field of Search ..... 212/308; 414/138.2, 414/138.3, 138.4, 139.6, 139.7, 141.7, 142.8

[56] References Cited

U.S. PATENT DOCUMENTS

| | | | |
|---|---|---|---|
| 2,998,148 | 8/1961 | Himel, Jr. | 414/139.7 X |
| 3,341,035 | 9/1967 | Black | 414/142.8 |
| 3,471,040 | 10/1969 | Field | 414/141.7 |
| 4,354,608 | 10/1982 | Wudtke | 212/191 |
| 4,544,137 | 10/1985 | Johnson | 254/337 |
| 4,593,885 | 6/1986 | Hackman et al. | 254/277 |
| 4,632,622 | 12/1986 | Robinson . | |
| 4,932,541 | 6/1990 | Belsterling | 414/139.7 X |
| 5,028,194 | 7/1991 | Robinson | 414/139.6 |
| 5,042,415 | 8/1991 | Hoffman | 212/308 X |
| 5,114,026 | 5/1992 | Hendrik | 212/191 |
| 5,511,922 | 4/1996 | Sekiguchi et al. | 414/139.6 |
| 5,685,683 | 11/1997 | Becker et al. | 414/141.1 |

FOREIGN PATENT DOCUMENTS

| | | | |
|---|---|---|---|
| 291826 | 1/1971 | U.S.S.R. | 414/142.8 |
| 1063700 | 12/1983 | U.S.S.R. | 414/137.7 |

*Primary Examiner*—Janice L. Krizek
*Attorney, Agent, or Firm*—McHale & Slavin

[57] ABSTRACT

This invention is drawn to a device for transporting cargo between a source position and a destination position utilizing a fixed crane-type device, e.g. an A-Frame, including a pivotal sub A-Frame in conjunction with a heave compensating assembly to which a main lifting cable is attached. The bulk of the lifting capacity is derived from a primary power source mechanically linked to the main lifting cable. As the source and destination positions move relative to each other, compensation for this motion is obtained via the coordinated reciprocal movement of an extensible connector, e.g. a wire rope and a lifting device mechanically linked between the main A-Frame and sub A-Frame, which is operative in response to sensory data input to the power unit's controller. The coordinated reciprocal motion acts to adjust the instantaneous load position thereby neutralizing the relative movement between the source position and destination position. The direct compensation provided by the interaction of the sub A-Frame, extensible connector and lifting device assembly provide enhanced neutralization of relative movement in either an active or passively controlled environment.

5 Claims, 5 Drawing Sheets

Passive Heave Compensation System Block Diagram

Active Heave Compensation System Block Diagram

COORDINATED MOTION MARINE LIFTING DEVICE

FIELD OF THE INVENTION

This invention relates to lifting devices for use in a marine environment, such as a ship or drilling platform, and particularly relates to a device capable of adapting an existing A-Frame and winch system to provide coordinated motion between a payload and the water's surface resulting in a neutralization of the relative motion therebetween.

BACKGROUND OF THE INVENTION

The transfer of objects in a marine environment is problematic in that the relative motion engendered between the water's surface and the object being moved must be taken into account and compensated for. Movement of large or heavy objects such as remotely operated vehicles (ROV), vessels and equipment represents a risky endeavor for many reasons, one of which is that large relative degrees of motion are induced into the load due to the ship's response to movement of the water's surface. Docking with or maneuvering near fixed objects, in the ocean or on the ocean floor, while suspended from a ship's crane or other lifting device is nearly impossible unless special means are taken to reduce or eliminate motions induced by the load. Additionally, when the induced motions are in excess of the load's terminal velocity in the water, snap loads occur in the lowering cable. These snap loads are dangerous to the survival of the cable, its terminations, and to the load and lifting device in general. Since these induced motions increase with increasing seas, the range of weather in which these lowering operations can be carried out is restricted. Since larger ships induce smaller motions, larger ships are often required for critical lowering operations in the widest range of weather conditions.

Various heave compensation devices have been proposed in an effort to overcome these difficulties. These devices generally attempt to maintain the load in a more or less fixed position relative to the earth, regardless of the motions that the ship is undergoing. These devices create reciprocating movements in the lowering cable in an attempt to compensate for the relative motion. Control of these devices may be either passive or active, with relative expense being a deciding factor in this regard. Various mechanisms are utilized in order to raise and lower the required amount of cable, including active winch drums, flying sheaves, and nodding booms.

PRIOR ART

U.S. Pat. No. 4,593,885 discloses a motion compensating device which is installed on a lift line and situated between a crane and an object to be lifted. The device consists of a hydraulic system and sheave mechanical system arrangement together with a balancing system for a given load range.

U.S. Pat. No. 4,354,608 discloses a motion compensating device for a crane hoist. A counterweight, connected to the reeving system, maintains a level of pretension upon the line. A hydraulic cylinder provides a cushioning effect at both ends of the counterweights travel and allows locking movement of the counterweight.

U.S. Pat. No. 4,544,137 provides a motion-compensated lifting apparatus which provides a traveling weight for maintenance of tension upon the load-lifting member, and a locking mechanism for prevention of movement of the traveling weight in one direction. Load direction sensing devices prevent lifting when the vessel is falling.

U.S. Pat. No. 4,632,622 provides an apparatus for transferring cargo including a pivotally connected linkage for connecting two locations so as to accommodate relative movement therebetween. Interaction of the linkage via the use of hydraulic cylinders articulates a compensating motion between the two locations.

U.S. Pat. No. 5,685,683 teaches a system for unloading bulk material from a ship. A float is positioned in the water transverse from and intermediate the ship and a stationary land-fixed location. An outer intake end of a pivotal bulk conveyor on the float is supported and maintained at a fixed height above the body of water and adjacent the ship. An opposite inner outlet end of the pivotal bulk conveyor on the float is supported at a fixed height above the stationary location. As the material is moved, it is transferred to an intermediate bunker car which is moved synchronously longitudinally with the pivotal bulk conveyor and the bucket conveyor.

U.S. Pat. No. 5,028,194 is drawn to a marine crane having an additional controllable variable lifting capability which is operably connected with the crane's load line and separately connected to the surface upon or from which an object is being lowered or lifted. The motion of the crane is compensated to provide for safe initial lifting of cargo from a supply vessel in response to wave action.

U.S. Pat. No. 5,114,026 describes a hoisting device including a cable controlled conventional crane winch assembly which operates in conjunction with a traction winch assembly inclusive of a traction device and storage winch. The use of the crane winch and traction winch assembly, in concert, enables both critical and long haul travel of cargo.

U.S. Pat. No. 5,511,922 a cargo loading and unloading system. A transport car carrying weight enters the ship through a gunwale opening via a ramp. A lift table, which permits the car to board, is positioned by various raising and lowering mechanisms and sensors which operate under the direction of a controller mechanism. Ramp angle and horizontality are maintained within fixed limits irrespective of the relative displacement of the ship's hull with respect to the adjacent wharf, so as to maintain smooth operation of the transport car between the wharf and lift table.

The complexity and mass of many of these systems limit their usefulness and the environments in which they can be utilized. Heave compensation techniques for extending the operational weather window of a reduced size ship have not had widespread use, partly because such specialized equipment must be built—the equipment already in use is not easily adapted for heave compensation use. A-Frames and winches, in common use offshore to lower heavy loads to the seafloor and to launch and recover remotely operated vehicles, have not been adapted to heave compensating devices.

If a heave compensation device was developed which was simple enough to be easily fitted to a class of existing offshore lifting systems currently using a winch and an A-Frame, and compact enough to bring heave compensating ability to reduced size vessels, a dramatic increase in the utility of such vessels would be realized thus satisfying a longfelt need in the art.

SUMMARY OF THE INVENTION

The instant invention is directed to a heave compensation device designed to be used in combination with a class of existing offshore lifting systems currently using a winch and an A-Frame. The configuration of this new system also allows a vehicle or any other launched load to be firmly captured until it is considerably closer to the water than was possible utilizing prior art techniques, thus reducing or eliminating dangerous pendulous swinging before the load enters the water. Heave compensation control may then be accomplished either actively or passively, depending on the operator's requirements and budget.

The instant invention defines a coordinated motion lifting device for use in a marine environment to position a load and neutralize relative movement between a source position and a destination position and includes:

1)a main A-Frame assembly characterized by a base, a primary means for support in pivotal engagement with said base characterized as having a proximal end and a distal end, and lifting means operatively attached to said primary means for support proximal end;

2)a sub A-Frame assembly characterized by a secondary means for support in pivotal engagement with said primary means for support, and a docking means in pivotal engagement with said secondary means for support proximal end, said secondary means for support further characterized as being operatively coupled with at least one extensible connecting means in mechanical engagement with said secondary means for support proximal end and said lifting means; and 3)a heave compensation assembly characterized by means for providing coordinated reciprocal movement between the main A-Frame assembly and sub A-Frame assembly;

whereby said coordinated reciprocal movement acts to adjust the instantaneous load position thereby neutralizing the relative movement between the source position and destination position.

Accordingly, it is an objective of the present invention to provide a coordinated motion lifting device for use in a marine environment to instantaneously position a load and thereby neutralize relative movement between a source position and a destination position.

It is an additional objective of the instant invention to provide a coordinated motion lifting device for use in a marine environment which utilizes a passive heave compensating assembly to dampen the response of the coordinated motion lifting device to relative movement between the source position and destination position.

It is yet another objective of the instant invention to provide a coordinated motion lifting device for use in a marine environment which utilizes an active heave compensating assembly to dynamically position the coordinated motion lifting device to neutralize relative movement between the source position and destination position.

It is still a further objective of the instant invention to provide a coordinated motion lifting device for use in a marine environment which includes, in combination, a main A-Frame assembly and a sub A-Frame assembly.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
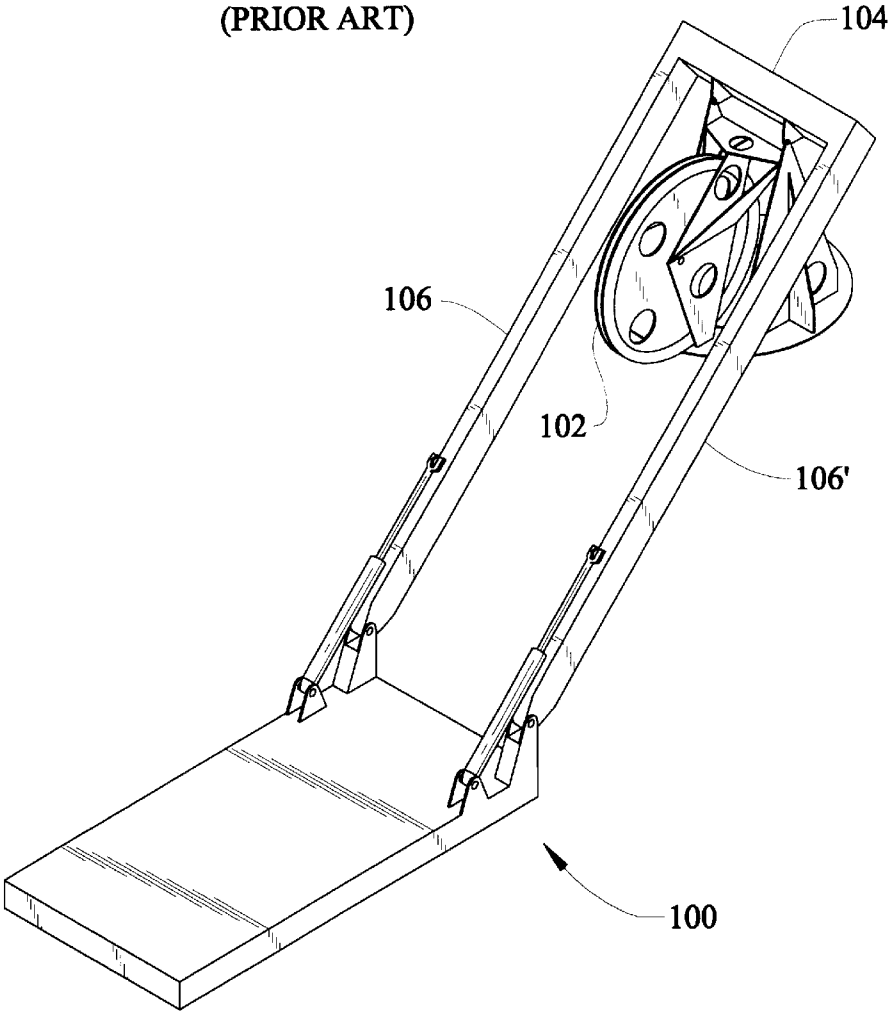
FIG. 1 (PRIOR ART)
FIG. 1 is a perspective view of a typical A-Frame assembly.

Referring to FIG. 1, a typical A-Frame 100 has a range of motion from about 45 degrees inboard to 45 degrees outboard. A large turning sheave or docking head 102 is usually fitted at the intersection of the proximal ends of the A-frame legs 106, 106', which in one embodiment, when the legs are in parallel relationship as depicted, may be bridged by a beam 104 connecting the top of the A-Frame's two legs 106,106'. The lifting cable 108 is passed over the sheave and connected to a load at one end (not shown) and to a main lifting winch or similar device (not shown) at the inboard end. In use, the load is typically hoisted from the deck with the A-Frame positioned inboard, the A-Frame is slewed outboard, and the load is lowered over the side or over the stern of the vessel using the winch.

Figure 2:
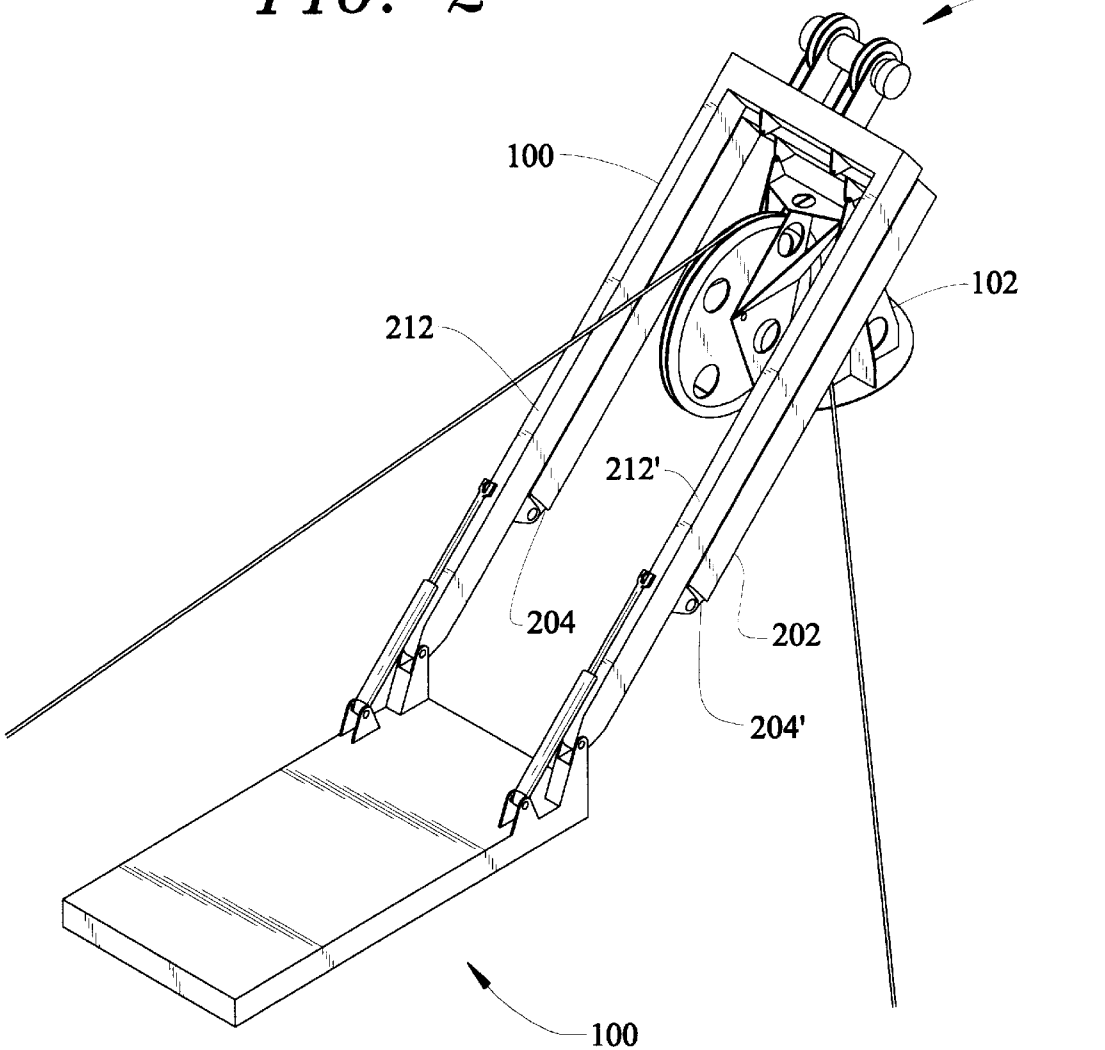
FIG. 2 is a perspective view of the instant A-Frame/sub A-Frame assembly.

With reference to FIG. 2, a smaller, lighter auxiliary or sub A-Frame 202 is pivoted from near the base of the existing A-Frame 100, via pivoting joints 204,204' which are attached to the main A-Frame outboard side. This sub A-Frame 202 is configured to nearly parallel the existing A-Frame's structure. In the illustrated embodiment, the legs are disposed in parallel fashion and the upper crossbeam 206 is initially latched to that of the existing A-Frame 100. The crossbeam 206 is designed to accept the existing sheave or docking head 102, or a custom built docking means capable of performing an equivalent function, as may be desired. An extensible connecting means, for example wire rope 208 is attached to a lifting means generally shown at 210, for example hydraulic cylinders, small hydraulic winches or equivalent devices effective for providing relative motion between the A-frame 100 and sub A-Frame 202. The lifting means are mechanically coupled to the structure of the existing A-Frame 100 and, subsequent to unlatching thereof, are used to position the sub A-Frame 202 dynamically as required by the type of control system chosen.

Figure 3:
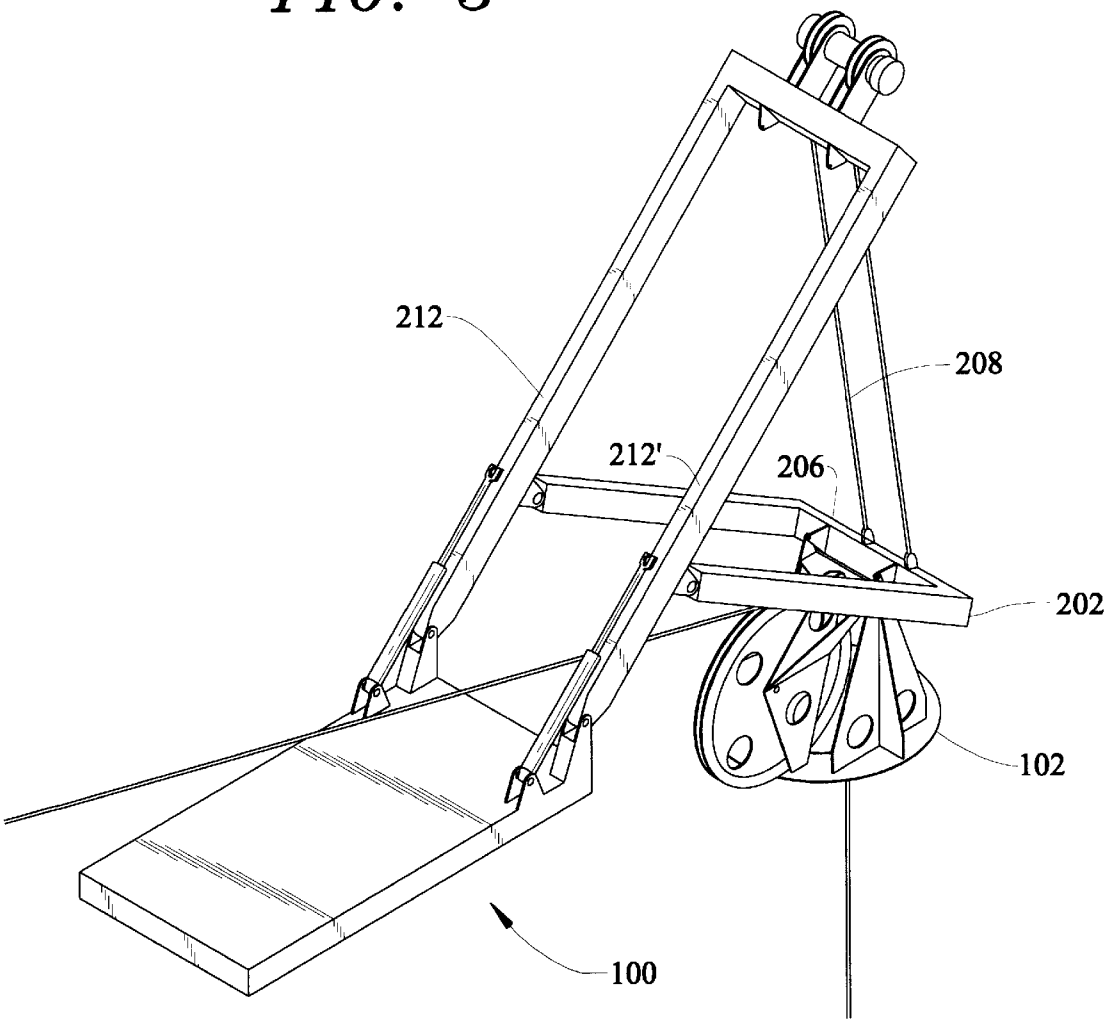
FIG. 3 is a perspective view of the sub A-Frame assembly in a lowered position with respect to the main A-Frame assembly.

As can be seen from the relative positioning of the sub A-Frame 202 in FIGS. 2 and 3, relative motion of the auxiliary or sub A-Frame 202 through its range relative to the existing A-Frame 100, which is in a stationary outboard position increases or decreases the distance of the docking head or sheave 102 from the water. Since the distance to the main lifting winch (not shown) is fixed, the effect of this motion is to raise or lower the load relative to the existing A-Frame 100 and ship (not shown). The sub A-Frame 202 can be made considerably lighter than the existing A-Frame 100, since the existing A-Frame remains the primary structural member. Light weight is a consideration in the dynamic response of the device. With attachment points near high strength areas 212,212 of the existing A-Frame 100, and on the crossbeam 206, simplified attachment is realized. The sub A-Frame's 202 lifting devices 210 are coordinated with the water-induced motion of the ship by virtue of either an active or passive heave compensation assembly to result in coordinated motion which neutralizes the relative motion between the source position and the destination position and thereby allows the load to remain nearly motionless in the water. In one embodiment, as more particularly set forth in FIG. 4, the use of hydraulic cylinders as lifting devices results in passive control of the load. In another embodiment, as set forth in FIG. 5, the use of small hydraulic winches results in active control of the load. It is emphasized that these particular embodiments are exemplary and alternative lifting devices which function in a like manner contemplated for use with these control schemes and are considered to be a part of the instant invention.

Figure 5:
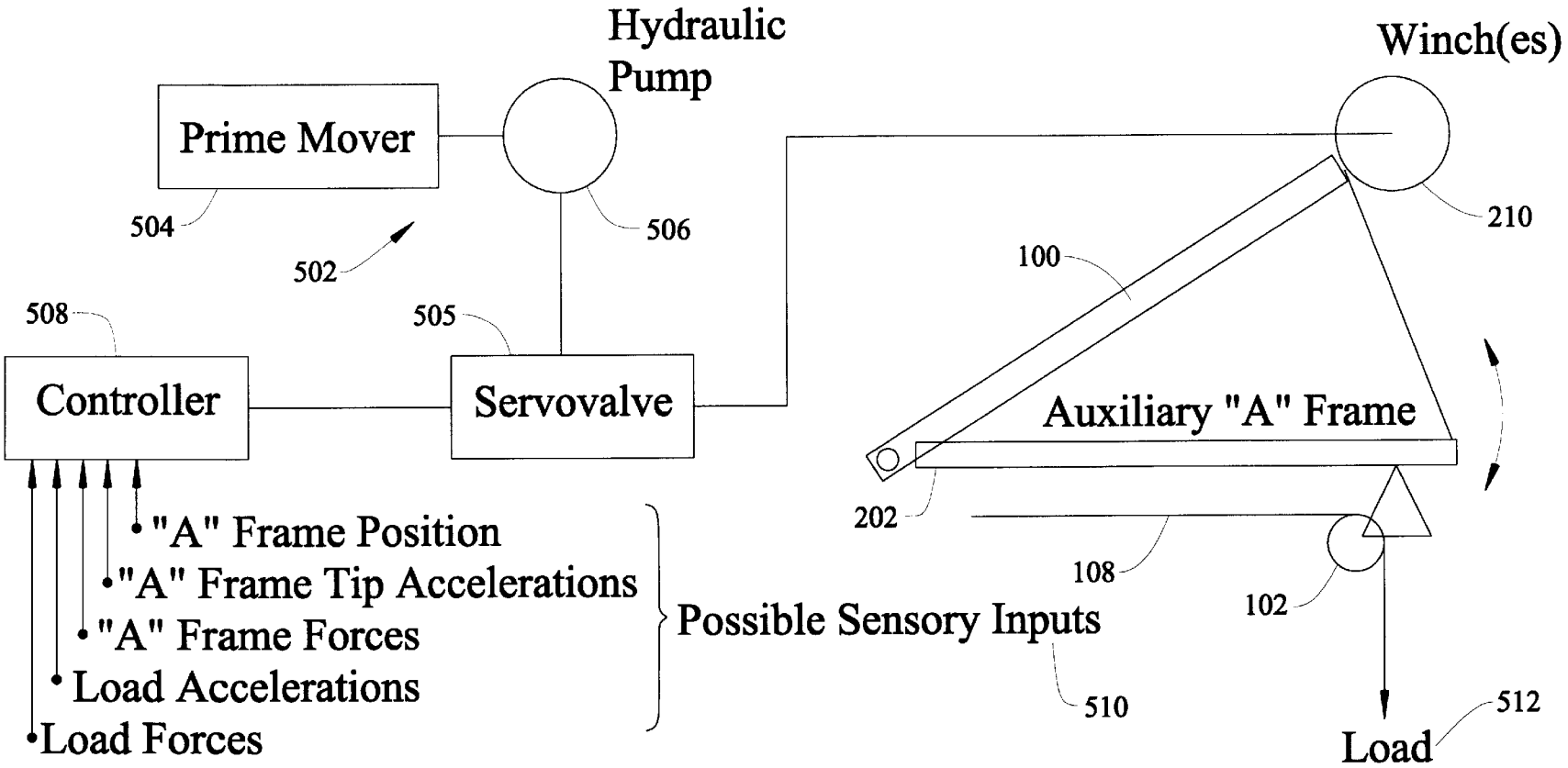
FIG. 5 is a block diagram of the components of an actively controlled heave compensation system.

With further reference to FIGS. 3 and 5 an active control embodiment is shown wherein a hydraulic power unit 502, comprising a prime mover 504 and a hydraulic pump 506, supplying a servovalve 505 is required. A controller 508 which may be a computer or one or more electronically controlled feedback loops, receives motion information from sensory inputs 510 which may be placed on the load 512, on the sub A-Frame 202, on the A-Frame 100, or all of the above. By way of these sensory inputs data regarding A-Frame position, A-Frame tip accelerations, A-Frame forces, load accelerations and load forces may be gathered. By appropriate processing of the motion information, the servovalve 505 may be dynamically positioned to drive the winches 210 to position the sub A-Frame 202 to minimize or eliminate the motion of the load relative to the earth. In this manner, the pressurized hydraulic fluid supplied by the servovalve dynamically positions the main A-Frame lifting means to control the coordinated motion lifting device and neutralize relative movement between the source position and destination position. This type of system is adaptable to a much wider variety of conditions than is the passive system.

Figure 4:
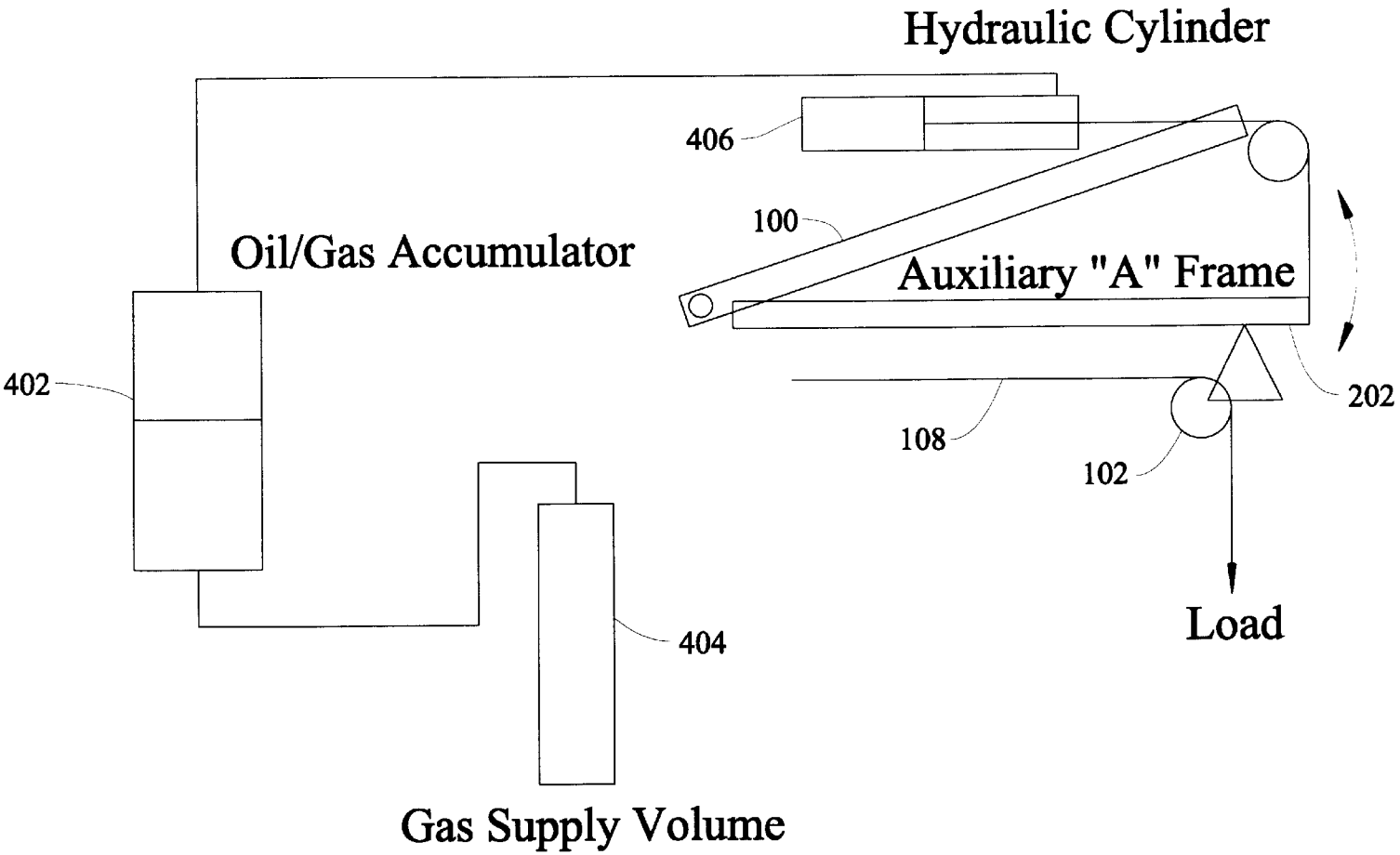
FIG. 4 is a block diagram of the components of a passively controlled heave compensation system.

Now referring more particularly to FIG. 4, in a passive control environment, a variable gas volume gas over oil hydraulic accumulator 402 may be used in conjunction with a variable charge pressure source supplied by gas supply volume 404 to produce a gas spring. The gas may be air or another suitable gas source. The oil from the accumulator would then be connected to the lifting side of a hydraulic cylinder 406. The gas spring is tuned to dampen the response of the combined lifting cable/load/sub A-Frame system to the motions of the ship. This type of system is tuned to the specific operating depth of the load.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A coordinated motion lifting device for use in a marine environment to position a load and neutralize relative movement between a source position and a destination position comprising:

a main A-Frame assembly including a base, a primary means for support in pivotal engagement with said base including a proximal end and a distal end, and lifting means operatively attached to said primary means for support distal end;

a sub A-Frame assembly including a secondary means for support in pivotal engagement with said primary means for support including a proximal end and a distal end, and a docking means in pivotal engagement with said secondary means for support distal end, said secondary means for support operatively coupled with at least one extensible connecting means in mechanical engagement with said secondary means for support distal end and said lifting means; and a heave compensation assembly including means for providing coordinated reciprocal movement between the main A-Frame assembly and sub A-Frame assembly;

whereby said coordinated reciprocal movement acts to adjust the instantaneous load position thereby neutralizing the relative movement between the source position and destination position.

2. The coordinated motion lifting device in accordance with claim 1 wherein:

said heave compensation assembly for providing coordinated reciprocal movement between the main A-Frame assembly and sub A-Frame assembly is a passive assembly including a variable gas volume gas over oil hydraulic accumulator having a gas side fluidly coupled to a variable charge gas pressure source to produce a gas spring, and further having an oil side fluidly linked to a hydraulic cylinder which is mechanically connected to said sub A-Frame assembly extensible connecting means;

wherein said passive assembly gas spring acts to dampen response of the coordinated motion lifting device to the relative movement between the source position and destination position.

3. The coordinated motion lifting device in accordance with claim 1 wherein:

said heave compensation assembly for providing coordinated reciprocal movement between the main A-Frame assembly and sub A-Frame assembly is an active assembly including a hydraulic power unit assembly including a prime mover operatively connected with a hydraulic pump for supplying pressurized hydraulic fluid via a servovalve and a controller for generating a signal to said servovalve in response to data received from at least one sensory input;

wherein the pressurized hydraulic fluid supplied by said servovalve dynamically operates the main A-Frame lifting means to control the coordinated motion lifting device and neutralize relative movement between the source position and destination position.

4. The coordinated motion lifting device in accordance with claim 3, wherein:

the at least one sensory input receives data selected from the group consisting of frame position, frame tip acceleration, frame forces, load accelerations, load forces, or combinations thereof.

5. The coordinated motion lifting device in accordance with claim 1, wherein:

said primary means for support includes a pair of primary parallel leg members in pivotal engagement with said base member, each said leg members having a proximal end and a distal end, and a primary connecting beam perpendicularly disposed between said primary parallel leg members and mechanically linked thereto at each said primary leg member distal end;

said secondary means for support includes a pair of secondary parallel leg members each having a proximal end and a distal end, a secondary connecting beam perpendicularly disposed between each said secondary parallel leg members and mechanically linked thereto at each said secondary leg member distal end;

said docking means is pivotally linked to said secondary connecting beam; and said at least one extensible connecting means is mechanically coupled to said secondary connecting beam and said lifting means.

* * * * *